United States Patent [19]

Kerzel

[11] Patent Number: 4,530,862

[45] Date of Patent: Jul. 23, 1985

[54] CONTROL SYSTEM AND METHOD FOR DISPENSING A LIQUID

[75] Inventor: David Kerzel, Pompano Beach, Fla.

[73] Assignee: Spraymation, Inc., Fort Lauderdale, Fla.

[21] Appl. No.: 489,790

[22] Filed: Apr. 29, 1983

[51] Int. Cl.[3] ..... B05D 5/10; B05C 11/10

[52] U.S. Cl. ..... 427/445; 118/669; 118/674; 118/699; 118/703; 427/208.2; 427/286; 427/288; 427/422; 427/424

[58] Field of Search ..... 118/669, 674, 683, 668, 118/682, 679, 684, 685, 699, 703; 427/286, 288, 422, 424, 445, 208.2

[56] References Cited

U.S. PATENT DOCUMENTS

| | | | |
|---|---|---|---|
| 3,212,715 | 10/1965 | Cocks | 239/125 |
| 3,408,008 | 10/1968 | Cocks | 239/135 |
| 3,662,927 | 5/1972 | Cocks | 222/146 |
| 4,084,539 | 4/1978 | Schmidt | 118/685 |

*Primary Examiner*—Evan K. Lawrence

*Attorney, Agent, or Firm*—Richard M. Saccocio

[57] ABSTRACT

In a liquid dispensing system which applies a liquid to a product moving past a liquid dispensing applicator, the improvement comprising dispensing a predetermined quantity of liquid per unit length of liquid dispensed by controlling the liquid operating pressure to coincide with a predetermined liquid pressure and by providing a flow bypass line which permits a continual flow of liquid through a liquid flow pump controlling the liquid operating pressure when the liquid dispensing applicator is not activated.

13 Claims, 4 Drawing Figures

CONTROL SYSTEM AND METHOD FOR DISPENSING A LIQUID

BACKGROUND OF THE INVENTION

1. Field of the Invention

This invention relates in general to the field of dispensing apparatus which dispenses liquids, including liquid adhesives and in particular to a method and apparatus for accurately controlling the amount of liquid dispensed relative to the amount of liquid required to be dispensed.

2. Description of the Prior Art

Dispensing apparatus, and in particular, adhesive dispensing apparatus has in the past been used to dispense a liquid adhesive for applying a discrete quantity of adhesive at predetermined time intervals to such products as paper cartons, baby or adult diapers, rolls of paper towels, rolls of bathroom tissue and other like products as the products move along a product conveyor line. The liquid adhesive is dispensed during the various stages of manufacturing for such purposes as securing the towels or bathroom tissue to the paper rolls, for securing the final wrap of towels or bathroom tissue to the full roll, for fastening together the multiple layers of disposable diapers, etc. Adhesive dispensing apparatus typically includes an adhesive storage or supply tank, one or more adhesive applicator heads, flow lines for connecting the adhesive supply to the adhesive applicator head, a pump for supplying the driving force to cause the flow of the adhesive, and apparatus for controlling the operation of the applicator head to achieve a desired pattern of application of the adhesive.

In the event a hot-melt adhesive is used, the apparatus further includes heating, insulation and additional control means to maintain the adhesive in a liquid state within each of the components comprising the adhesive dispensing apparatus. Hot-melt adhesives generally produce stronger bonds and cure more rapidly than comparable cold adhesives. In commercial production line applications where both high volume and high quality are necessary, hot-melt adhesives are therefore preferred. As previously noted, however, hot-melt adhesives require additional apparatus and controls to assure proper application of the adhesive to a product to achieve the desired result.

In the above-described applications, the dispensed adhesive may be in the form of small dots, thin dashed or solid lines, large dots, broad dashed or solid lines, etc. The lines or dots of adhesive are usually applied in a direction coincident with the direction of movement of the product as it travels past a fixed position of the adhesive applicator. In applications where a series of multiple lines or dots of adhesive are to be applied, a number of applicators may be ganged together or a multiple outlet adhesive applicator may be used. The adhesive applicator is usually the only component of the dispensing system which is located in the immediate vicinity of the product. The remaining components, for example the supply tank, pump, etc., are usually remotely located relative to the product.

Typically, in the prior art, control apparatus is used to insure the maintenance of the correct temperature of the adhesive and to insure that the dispensing apparatus dispenses the correct amount of adhesive at the correct location on the product. One such example of the prior art control apparatus is shown in U.S. Pat. No. 3,408,008, issued Oct. 29, 1968 by Eric H. Cocks, entitled "Apparatus for Applying Hot-Melt Adhesives."

In other prior art methods and apparatus for controlling the dispensing of the adhesive a shaft speed encoder or other similar transducer is used to time the dispensing of the adhesive relative to the speed of the product passing by the adhesive applicator. The shaft speed encoder is typically attached to the shaft of a motor or to a shaft forming part of the product conveyor line. The output of the shaft speed encoder is input to the timing controls of the adhesive applicator. In this manner, a change of speed of the product passing by the adhesive applicator results in a corresponding change in the discharge of the adhesive applicator so as to correctly position the lines or dots of adhesive regardless of changes of speed in the product conveyor system.

The importance of properly controlling the dispensing of the adhesive is more clearly understood when viewed in consideration of the manufacture of products such as baby diapers. In such manufacture, a continuous web of non-woven material is moved past one or more applicator heads at high speeds. Control signals having a relatively constant time delay cause the applicator head to open and the adhesive, being under pressure, is applied to the fast moving web of material. Providing that the pressure remains constant and that there are no other variations in the system and providing the web (product) speed of travel remains constant, the lines or dots of adhesive are accurately and uniformly placed where required and in an amount that is required. However, in the event of a change in web or product speed, which can and often does occur in production lines, the adhesive will be misplaced on the product unless provision is made to correct for the speed change.

Speed variations typically occur during conveyor line startup and shutdown, during planned conveyor line speed adjustments and during unplanned speed adjustments, such as for malfunctions, product component co-ordination, equipment failure, shift changes, etc. An uncompensated faster or slower speed results in misplaced adhesive. This occurs because the location of the applied adhesive is dependent upon the time delay between the control signal and the opening of the applicator head which remains reasonably constant and upon the speed of the product which does not remain constant. Thus, if the product moves faster, the adhesive applied will be placed behind the correct location in proportion to the amount that the product speed has increased. Similarly, if the product speed decreases, the adhesive will be placed forward of the correct location. Further, if the length of the laid down line of adhesive is controlled as a function of time, not only will the starting point of the line of adhesive be improper but the length (and consequently the amount) of adhesive will similarly be improper.

The use of the previously mentioned shaft speed encoder is one prior art attempt to solve the above-stated problem. The shaft speed encoder being synchronized with the conveyor or product speed senses a change in product speed and, through appropriate electronic circuitry, adjusts the timing of the activation of the adhesive applicator so as to correctly reposition the location of the adhesive on the moving product and to lay down a correct length of adhesive.

Another prior art problem concerns the amount of adhesive applied relative to variations in the speed of the product along the conveyor line. If the conveyor line speed changes, and the location of the length of the line of adhesive is correctly adjusted by suitable control means, and if no other corrections are made, then a given length of adhesive will contain either more or less adhesive relative to the change in web speed. For example, a change in product speed of twenty percent would result in a twenty percent change in the amount of adhesive placed at a particular location. In practice, too much adhesive is costly; while too little adhesive can cause a product failure. For every application there is a preferred line or dot of adhesive placed in a correct starting and ending position and in an amount of adhesive which is optimal for that application. A usual prior art method of attempting to insure the dispensing of a correct amount of adhesive relative to the speed of the product line involves changing the pressure of the adhesive within the adhesive dispensing system in accordance with controls again influenced by the shaft speed encoder.

For a given timed opening of an applicator head, an increase in pressure will result in more adhesive being dispensed. Alternatively, a decrease in pressure results in less adhesive being dispensed. For example, in a system utilizing a DC motor to drive a gear pump, speeding up or decreasing the speed of the DC motor correspondingly changes the speed of the gear pump which increases the volume pumped and hence the pressure output thereby. By using the shaft encoder to control both the timed sequence of operation or opening of an adhesive applicator and the speed of the gear pump, both prior art problems are solved to some degree. Unfortunately, this prior art solution is not a complete solution. The relationship between pressure and pump speed is not a linear relationship. Also, the relationship between pressure and fluid flow rate is not linear. Hence, the use of pump speed in response to conveyor line speed only to change the pressure to compensate for variations in conveyor line speeds will not completely eliminate variations in the amount of adhesive deposited for a given length of line of adhesive.

The above-stated prior art problem exists not only in adhesive dispensing systems but any system which involves the dispensing of a predetermined quantity of liquid while a conveyor line is in motion. For example, the dispensing of eye shadow or eye liner into a container moving along a conveyor line.

It is, therefore, an object of the present invention to provide a method and control apparatus for use with an adhesive dispensing system for applying a given length or dot of adhesive at a predetermined and preferred position on a product driven past an adhesive applicator regardless of any variation in conveyor line speed.

Another object of the present invention is to provide a method and apparatus for use with an adhesive dispensing system for applying a predetermined and constant amount of adhesive per length of line of adhesive or per size of dot of adhesive application regardless of any variation in conveyor line speed.

It is still another object of the present invention to provide a method and apparatus for use with an adhesive dispensing system which will apply a predetermined length and a predetermined quantity of adhesive at a predetermined location on a product being driven past an adhesive applicator head regardless of any variation in conveyor line speed.

An even further object of the present invention is to provide a method and apparatus for use with a liquid dispensing system which will apply a desired and preferred quantity of a liquid to a container moving along a conveyor line while said container is in motion and regardless of any variation in conveyor line speed.

SUMMARY OF THE INVENTION

In accordance with the above objects, the present invention overcomes the problems of the prior art in providing a method and apparatus which utilizes a combination of system pressure and conveyor line or product speed in controlling the amount of liquid dispensed, such as for use with an adhesive dispensing system or any other liquid dispensing system where the liquid is being dispensed while the conveyor line is in motion.

An orificed flow bypass line is provided downstream of a pump for continuously circulating a liquid from a supply source to the pump and back into the supply source. In this manner a relatively constant system operating pressure or liquid operating pressure is provided notwithstanding operation of the liquid applicator and notwithstanding any change in speed of the conveyor or product line, including when the conveyor line is completely stopped.

System operating pressure is controlled by a controller which is supplied separate information from a pressure transducer which monitors the actual system operating pressure and a shaft speed encoder which monitors the speed of the product conveyor line. The signal from the shaft speed encoder is modified by gain and offset controls in order to input a signal to the controller which represents a desired predetermined and constant volume of adhesive per unit length of line of dispensed adhesive, notwithstanding any variations in the speed of the product conveyor line. The controller compares the actual to the desired system operating pressure and if an adjustment is required, transmits a corrective signal to a motor controller which varies the speed of the pump to modify the pressure output therefrom. This monitoring and control process continues throughout production resulting in very precise dispensing of a desired quantity of adhesive or other liquid.

Various other objects, advantages and features of the invention will become apparent to those skilled in the art from the following discussion taken in conjunction with the following drawings, in which:

DESCRIPTION OF THE PREFERRED EMBODIMENTS

Figure 1:
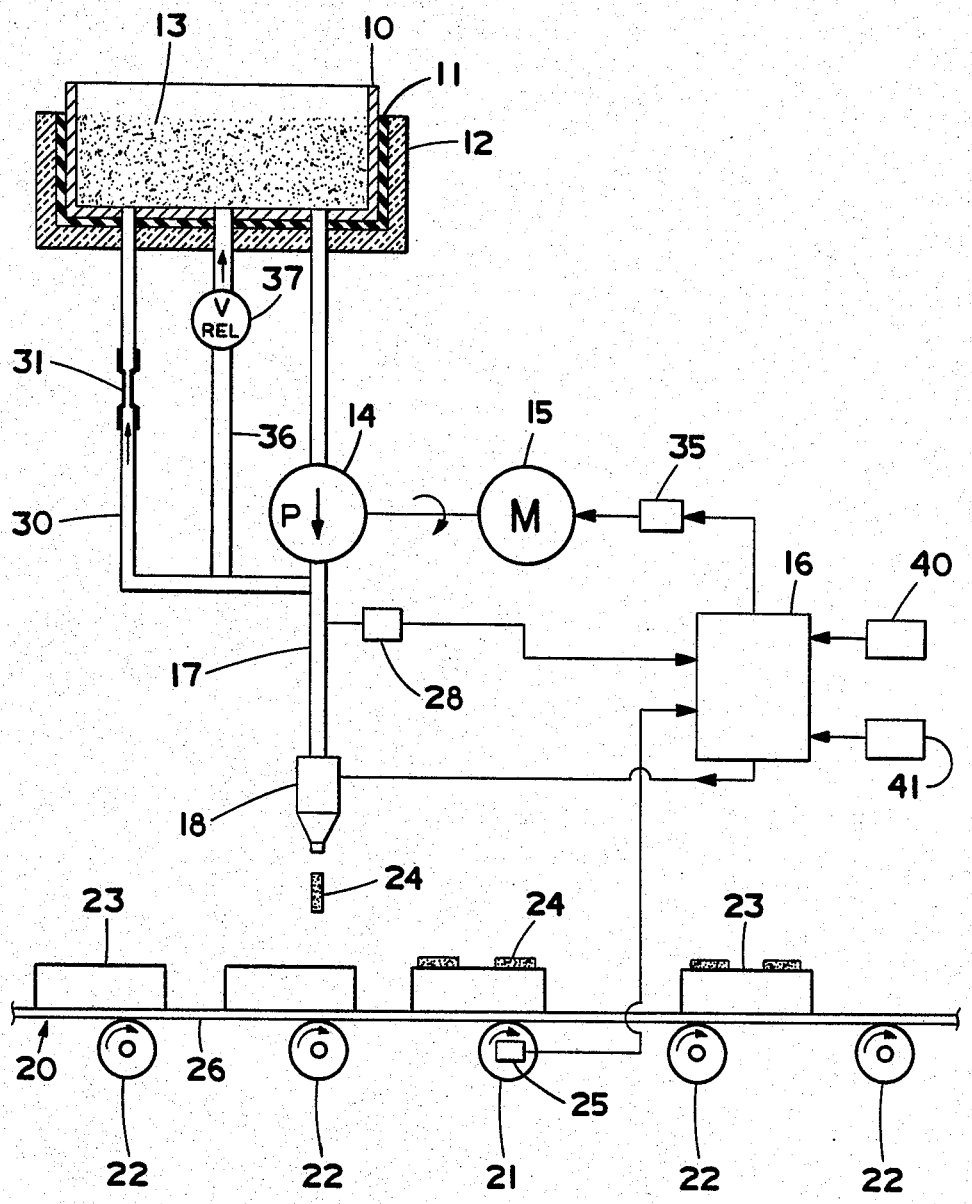
FIG. 1 is a schematic flow and control diagram of a typical hot-melt adhesive applicator flow system illustrating one embodiment of the present invention.

Referring now to the drawings, the present invention will be described for use with a typical adhesive dispensing and control system which is schematically depicted in FIG. 1. It is to be noted however, that while the present invention is being described for use with an adhesive dispensing system, the invention is not to be limited thereby and may be used with any liquid dispensing system where a product or a container is being driven along a conveyor line and dispensing of the liquid occurs while the product or container is in motion on the conveyor line.

An adhesive supply tank 10 is utilized for the immediate storage and supply of a liquid adhesive. In the case of a hot-melt adhesive system, an appropriate heater and insulation 11 and 12, respectively, are fitted to tank 10 to maintain the temperature of the adhesive 13 within tank 10 at a predetermined temperature which typically is in the approximate range of 150°–450° F. so as to maintain a predetermined viscosity of a hot-melt adhesive 13. Liquid adhesive 13 from tank 10 is input to the low pressure or suction port of pump 14. Pump 14 may be a gear type mechanical pump, a positive displacement reciprocating pump, a centrifugal pump, a pressure source which applies a pressure to the space above the adhesive within the adhesive supply tank, or generally any means of suitably applying a variably controlled pressure to the adhesive. An essential feature of pump 14 is the ability to positively and accurately vary the pressure of the adhesive as it is output from pump 14 as for example by a change in pump speed. In the arrangement shown in FIG. 1, motor 15 is a variable speed motor operationally connected to pump 14 such that a change in motor 15 speed results in a change pump 14 speed. Controller 16 through motor control 35 controls the operation of motor 15.

The pressurized adhesive output from pump 14 is channeled through conduit 17 to one or more adhesive applicators 18. Conduit 17 typically comprises a heated and insulated high pressure flexible hose of a type which is well known in the field of hot-melt dispensing systems. Adhesive applicator 18 may comprise an airless solenoid operated applicator of a type as described in U.S. Pat. No. 3,408,008, issued Oct. 29, 1968 by Eric H. Cocks, entitled "Apparatus for Applying Hot-Melt Adhesives."

A typical moving conveyor arrangement 20 which may comprise a conveyor belt 26, a motor driven roller 21 for driving belt 26, and a plurality of idler rollers 22 is employed to move a product 23 to which adhesive 24 is to be applied in a predetermined location in a predetermined amount. Product 23 may comprise any one of a multitude of products, for example: discrete items such as cardboard boxes with varying amount of distance, if any, between the boxes; relatively long, uncut lengths of toilet tissue or paper towels; long continuous lengths of non-woven material such as that used for baby diapers. In any event, product 23 is caused to move in conformity with the motion imparted by driven roller 21. Applicator 18 is appropriately mounted in the immediate vicinity of product 23 on conveyor arrangement 20 at a location where the predetermined amount of adhesive 24 is to be applied to product 23. FIG. 1 schematically depicts this arrangement. The actual physical arrangement of the same is well known in the art.

A shaft speed encoder 25 or other functionally similar type of transducer is attached to driven roller 21 such that the travel speed of product 23 is sensed, "read" or monitored by shaft speed encoder 25 and input to controller 16 which in turn activates applicator 18 at a precise predetermined time and for a precise predetermined length of time so as to apply a desired length of line of adhesive at a desired location on product 23. Hence, the operation of applicator 18 is synchronized with the speed of product 23. If, for example, the speed of product 23 increases, the shaft speed encoder 25 "reads" the speed increase and correspondingly decreases both the "off" and the "on" time intervals of the operation of applicator 18. Thus, a correct length of adhesive is again applied to an again correct position on product 23. However, unless a change is made to the output pressure of the pump 14, an incorrect amount of adhesive will be applied. If the speed of product 23 increases, a lesser amount of adhesive will be applied. Thus, an increase in pump 14 pressure is required so as to force more adhesive through applicator 18 during the shortened time interval the applicator is "on" or activated. The increase in pump 14 pressure is obtained by increasing the pump 14 speed by increasing the motor 15 speed by motor control 35 and controller 16 in accordance with the previously mentioned monitoring by the shaft speed encoder 25. Therefore, the shaft speed encoder 25, simultaneously changes both the time of operation of applicator 18 and the speed of pump 14.

The change in pump 14 output pressure by controlling pump 14 speed in accordance with the signal from shaft speed encoder 25 to controller 16 does not produce a totally satisfactory solution. Pump output pressure is not directly proportional to pump speed. Thus, the use of shaft speed of pump 14 alone to control the pressure output of pump 14 results in variations from the pressure actually desired. Variations in pressure output in relation to pressure desired also occurs due to different rates of flow through pump 14. The use of pressure sensor or transducer 28 in conjunction with shaft speed encoder 25 corrects for such undesirable pressure output variations. Pressure sensor 28 is operationally connected to the output of pump 14. The output of pressure sensor 28 is input to controller 16. Pressure transducer or sensor 28 may be an electromechanical device which produces a voltage in direct proportion to the pressure applied to the transducer or to the pressure to which the transducer is exposed.

Still referring to FIG. 1, a bypass line 30 connects the high pressure output line 17 of pump 14 to tank 10. A flow restricting orifice 31 is fitted within line 30. The size of orifice 31 varies in any given adhesive dispensing system. In prototype testing, however, it has been determined that an orifice having a diameter of approximately 0.010 to 0.025 inches is satisfactory for systems using two or six applicators. However, the exact range of the size of orifice 31 must be determined for each system in accordance with pump size, operating pressure, adhesive temperature and viscosity, number of applicators being used, etc.

Bypass line 30 allows for a flow rate through pump 14 when applicator 18 is not activated and for an increased flow rate when applicator 18 is activated. The advent of a continuous substantially constant flow rate through pump 14, whether or not applicator 18 is activated, serves to minimize the relatively high instantaneous drop in pressure within applicator 18 upon the initial activation thereof as well as the normal drop in pressure in the system thereafter as a result of the flow of adhesive through applicator 18. Thus, line 30 serves to eliminate or substantially reduce pressure surges within line 17 and applicator 18 which results in substantially improved and predictable dispensing of a liquid adhesive. This improved performance also lessens the adhesive dispensing system control requirements in that it is substantially easier to control a system pressure which experiences relatively small, constantly occurring pressure drops rather than a widely fluxuating system pressure which would exist within line 17 and applicator 18 without bypass line 30. For example, assuming that without line 30 the activation or operating pressure of applicator 18 and within line 17 is 500 psi. Upon activation of applicator 18, there will be an instantaneous drop in pressure in line 17 to perhaps 200 psi or even lower. The relatively small volume within line 17 and applicator 18 in part is responsible for the rapid and large drop in pressure. There then will necessarily be a time lag for pump 14 to respond to the decrease in pressure and build the same back up to 500 psi. With line 30 in place and adhesive flowing therethrough, activation of applicator 18 will drop the pressure within line 17, for example, by 50–100 psi. Consequently, there will be lesser of a time lag before pump 14 builds the pressure back to 500 psi. Since there are also time lags associated with sensing the larger drop in pressure by sensor 28, with controller 16 signaling the required change to motor 15 and with motor 15 responding to the control signal, a lesser instantaneous pressure drop reduces all such lag times and increases system performance.

Also, with bypass line 30 in place, there is no need to stop motor 15 and pump 14 as for example with the use of positive displacement pumps and during those time intervals when applicator 18 is not activated. When the pump 14 is stopped, it will take more time to overcome the inertia of motor 15 and pump 14 to build up the system pressure following activation of applicator 18 than the time interval between adhesive flow cycles. Bypass line 30 permits continuous flow and hence continuous pump 14 and motor 15 operation. Thus, system pressure is constantly being maintained for immediate use upon activation of applicator 18.

In typical fashion, safety bypass line 36 in conjunction with safety valve 37 prevents possible damage to applicator 18 and high pressure line 17 by relieving the pressure therein to the relieving pressure of valve 37. In this regard, bypass line 30 and orifice 31 serve an additional advantageous function. When the dispensing system is shut down as for servicing, the end of production, the end of the day's work, inspections, etc., the pressure within line 17 remains at the system operation pressure. Bypass line 30 and orifice 31 reduce this pressure to zero by venting the same to the supply tank 10. Also, consider the startup of the system after the adhesive has been cooled and solidified within the system. Since the internal volume of the system is small, a subsequent rise in temperature could result in a considerable increase in pressure far beyond normal operating limits resulting in possible damage to the system and the creation of a safety hazard due to the escaping hot adhesive. Bypass line 30 and orifice 31 positively preclude the occurrence of such events. Thus, bypass line 30 and orifice 31 serve important safety functions and to backup safety line 36 and relief valve 37.

In addition to the above, the pressure output by pump 14 is also controlled by gain control 40 and offset control 41. Thus, as will be explained more fully hereinafter, the actual operating pressure within applicator 18 is controlled by the combination of the shaft speed encoder 25, pressure transducer 28 and gain 40 and offset 41 controls.

For purposes of explanation of the operation of the dispensing system in FIG. 1, it will be assumed that roller 21 is driving a product 23 past the adhesive applicator 18. Shaft speed encoder 25 is operationally connected to roller 21 and is synchronized with the travel speed of product 23. Applicator 18 is not activated, hence with pump 14 operating, adhesive is flowing from tank 10 through pump 14 through line 30 and orifice 31 and back into tank 10. Pressure transducer or sensor 28 is monitoring or sensing the pressure of the adhesive flowing through line 30. System pressure is set by controller 16 in accordance with the output of shaft speed encoder 25 and the settings of the gain 40 and offset 41 controls. In setting the system pressure, controller 16 adjusts and controls motor speed control 35 which, of course, controls the speed of motor 15 and hence the speed of pump 14 to obtain the desired pressure of the adhesive fluid in line 30 and line 17. Pressure sensor 28 serves to sense the operating pressure in lines 30 and 17 inputting a signal corresponding to the operating pressure to controller 16 for further control of the speed of motor 15 through control 16 and motor speed control 35. Thus, the pressure output of pump 14 is controlled both by pressure sensor 28 and shaft encoder 25.

When controller 16 signals applicator 18 to dispense a predetermined length of line of adhesive containing a predetermined quantity of adhesive 24, applicator 18 which may comprise an electromagnetic or an air-operated device responds by withdrawing a needle from a seat within the applicator allowing the pressurized adhesive therein to flow through and out of an orifice thereby exiting from applicator 18. This flow of adhesive would normally cause an instantaneous large drop in pressure in line 17, however, because of the continuous flow through line 30, the resulting pressure drop is minimized, and further, pressure sensor 28 immediately initiates a correction for the change in pressure. The speed of motor 15 and pump 14 are increased through the operation of controller 16 which operation is initiated by pressure sensor 28. Thereafter, pressure sensor 28 continues to monitor the adhesive pressure and controller 16 compares the same with the desired pressure and constantly adjusts the speed of motor 15 and pump 15 to hold the required pressure. Similarly, when applicator 18 is deactivated, pressure sensor 28 senses the rise in pressure and controller 16 reduces the speed of pump 14 thereby lowering the pressure of the adhesive within lines 30, 17 and applicator 18.

In the event the system is operating at the desired pressure and applicator 18 is dispensing adhesive at a predetermined location having a predetermined length and containing a predetermined quanity of adhesive, but then the speed of product 23 changes, the change of speed will be noted by shaft speed encoder 25. A signal will be sent to controller 16 by encoder 25 which in turn will change the operating time intervals of applicator 18 so as to again apply the required length of adhesive at its required location on product 23. However, without a corresponding change in pressure, the quantity of adhesive contained within the applied length of adhesive will be improper. Pressure sensor 28, in conjunction with shaft encoder 25 and the circuitry of controller 16 combine to adjust the pressure output by pump 14 such that an again correct amount or quantity of adhesive per unit length of line of adhesive is applied to product 23.

Figure 2:
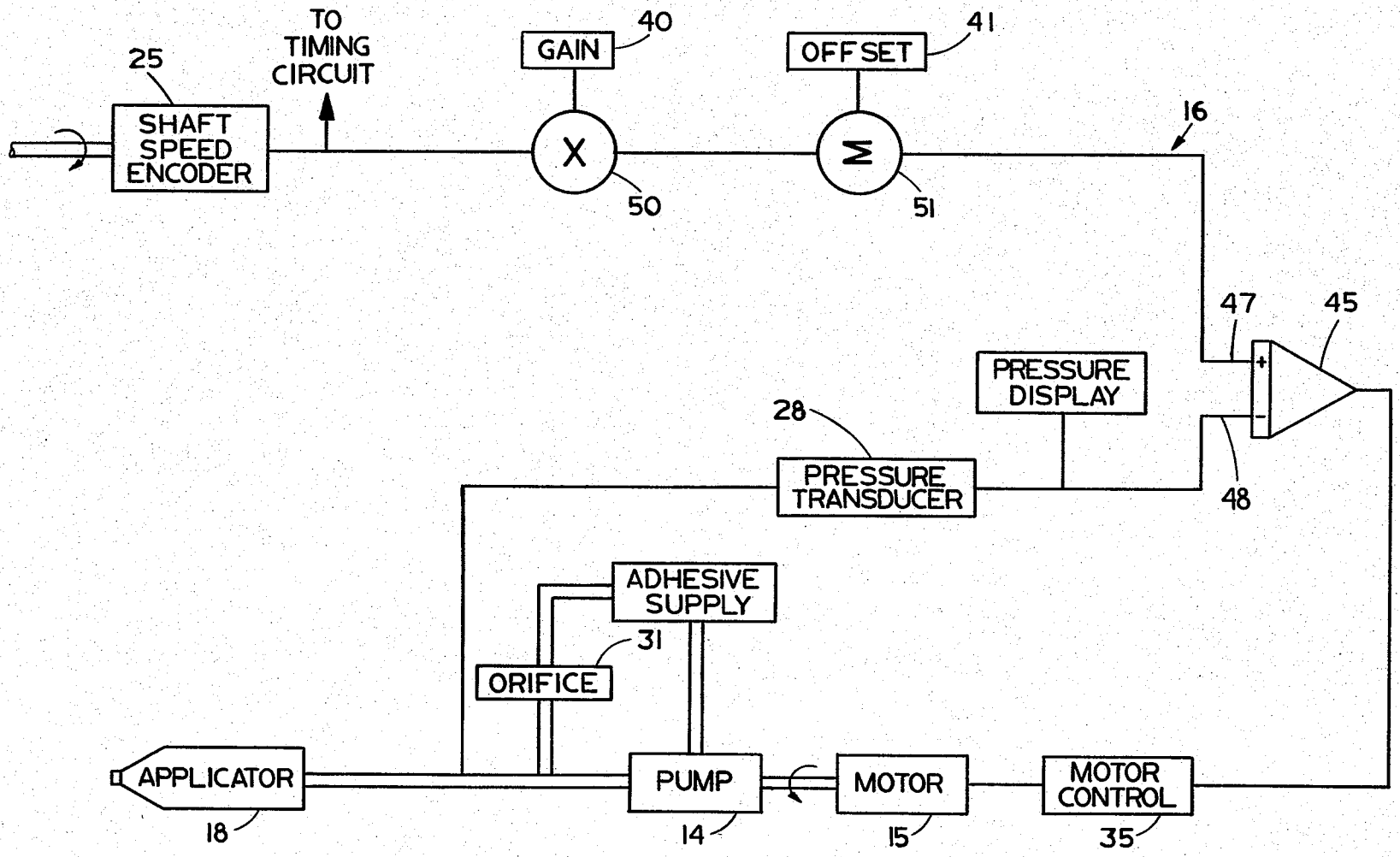
FIG. 2 is a closed loop block diagram of the controller circuit of the embodiment of FIG. 1.

The manner in which system control 16 readjusts the pressure output by pump 14 is schematically shown in FIG. 2. A comparator-operational amplifier 45 includes input legs 47 and 48. Input leg 47 is furnished an electrical signal in accordance with shaft speed encoder 25, gain control 40 and offset control 41. The signal at input leg 47 represents an ideal or desired system operating pressure over the range of speed of the product 23 which in the example used is driven by roller 21. Hence, the signal at input leg 47 varies as a function of the speed of product 23 as it is driven past an adhesive applicator 18. Input leg 48 is furnished an electrical signal in accordance with the actual system operating pressure as monitored by pressure transducer 28.

Comparator-operational amplifier 45 compares the desired system pressure with the actual system operating pressure and mathematically determines the difference, if any, between the two signals and inputs this information to motor control 35. If the desired pressure is greater than the actual operating pressure, comparator-operational amplifier 45 will input a signal to motor control 35 such that the speed of pump 14 will increase to output a greater pressure. Conversely, if the desired pressure is lower than the actual operating pressure, comparitor-operational amplifier will cause a decrease in speed of pump 14. When the system pressure is the same as the desired pressure, no change in signal is sent to motor control 35. Consequently, the actual system operating pressure is caused to follow or coincide with the desired system pressure notwithstanding any change in speed of product 23 or conveyor belt roller 21.

It is to be noted that controller 16 through the arrangement shown in FIG. 2 accomplishes a relatively unusual result. The pressure output of a pump is non-linear, i.e. that it does not uniformly increase with the speed of the pump. On the other hand, the signal input at leg 47 is linear, i.e. it does uniformly increase with product 23 speed. Since the arrangement of FIG. 2 causes the actual pressure to coincide with the desired pressure, the system pressure as pressurized by pump 14 is made to uniformly increase (or decrease) with product 23 or roller 21 speed. The non-linear aspects of pump 14 are substantially factored out of the system. This highly desirable result is accomplished, in part, by gain control 40 and offset control 41. The voltage signal output by shaft encoder 25 is multiplied by a signal input by gain control 40 which may comprise a potentiometer, by multiplier 50. Offset control 41 which may comprise a potentiometer adds to the voltage signal output from multiplier 50 by adder 51.

Figure 3:
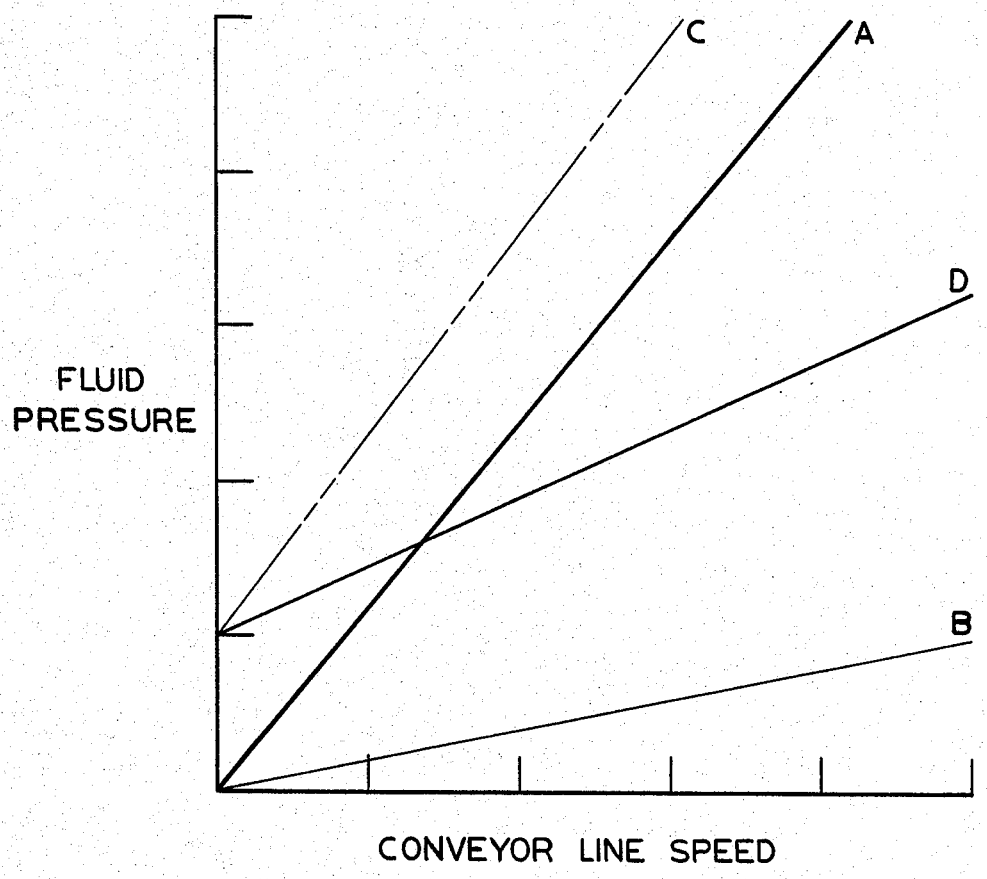
FIG. 3 is a graph illustrating the effect of the offset and gain controls on the pressure of the adhesive as a function of conveyor line speed; and, FIG. 4 is a graph illustrating the amount of adhesive dispensed as a function of conveyor line speed and as modified by the embodiment of FIG. 1.

The effect of the gain 40 and offset 41 controls is representatively shown in FIG. 3. Curve A is representative of a voltage signal output by shaft speed encoder 25 as a function of conveyor line speed or product 23 speed. The relationship is linear. Shaft speed encoder 25 outputs a voltage signal, the value of which increases linearly with the speed of the shaft to which it is attached. The voltage signal is input to motor control 35 which controls pump 14 speed and the pressure output therefrom; thus, the voltage signal may also be expressed in terms of pressure of the adhesive within the system as expressed in FIG. 3.

Curve A of FIG. 3 may be expressed algebraically as $Y=MX+N$ where both M and N are constants and X is the conveyor line speed of the product 23 or in the alternative the conveyor line speed. Y represents the desired operating pressure of the system. The constant M is, of course, the slope of curve A. By changing the slope of curve A (the value of M) representative curve B results. The slope of curve B is less than the slope of curve A. By changing the value of N, the origin of curve A may be changed from zero to a positive pressure (over and above the positive pressure due to line 30 and orifice 31). Hence, curve A may be changed to that of curve C (shown as a dotted line). Curve D represents a change in both of the constants M and N or curve A, and is intended in combination with positive pressure resulting from bypass line 30 and orifice 31 to represent the desired system fluid pressure as a function of conveyor line speed.

The change in M is accomplished by gain control 40; the change in N is accomplished by offset control 41. Gain control 40 and offset control 41 may comprise potentiometers or may alternatively comprise switching attenuators or other suitable well known electronic devices arranged as shown in FIG. 2. The voltage output derived from shaft speed encoder 25 (X in the expression $Y=MX+N$) is multiplied using a voltage multiplier 50 by a signal which is controlled by gain potentiometer 40. Offset potentiometer 41 inputs a signal to voltage adder 51. The voltage added by offset 41 (N in the expression $Y=MX+N$) is thus added using adder 51 to the output of voltage multiplier 50. Consequently, the invention provides a means whereby a desired adjustable and controllable voltage (system fluid pressure) may be input at leg 47 to comparator-operational amplifier 45. In other words, the invention provides a means whereby a signal corresponding to a desired system fluid pressure which varies as a function of conveyor line speed and representatively shown as curve D of FIG. 3 may be input to leg 47 of amplifier 45. And, as explained above, the amplifier 45 functions to control the actual system pressure in accordance with the desired system operating pressure.

Figure 4:
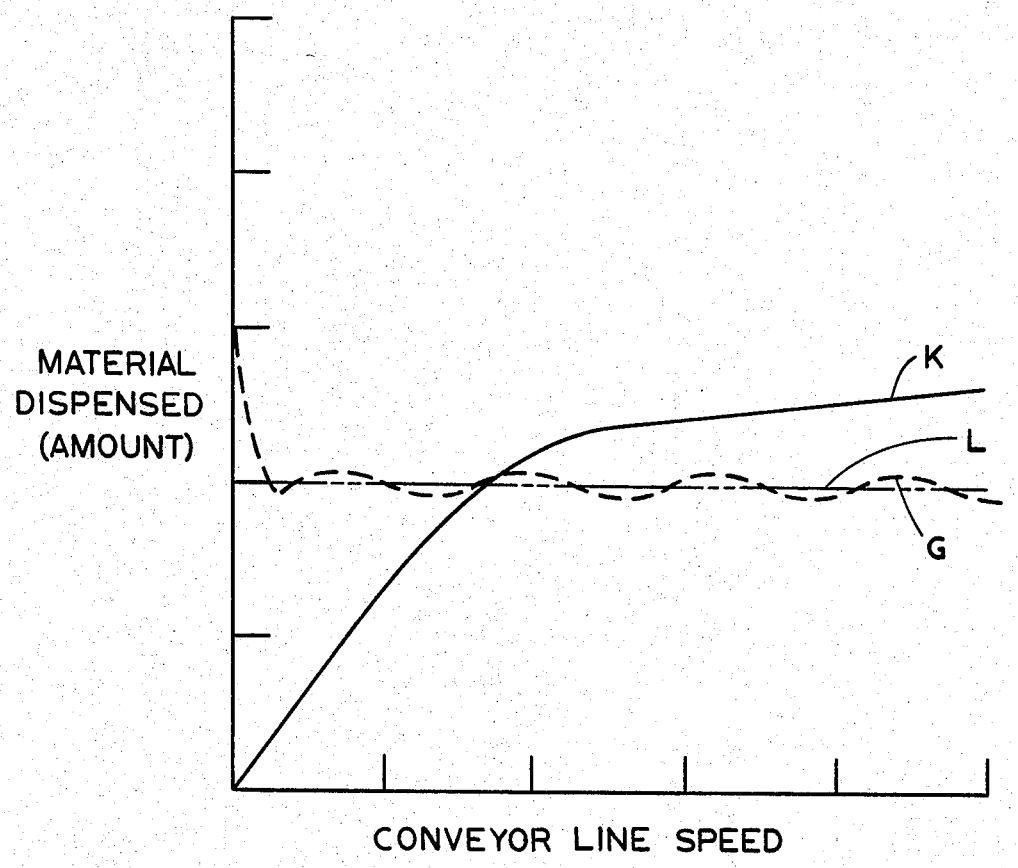

FIG. 4 is further illustrative of the effect of the inventive apparatus in terms of adhesive material dispensed from an adhesive applicator as a function of conveyor line or product speed. Curve L represents the ideal desired effect. That is, regardless of the speed of the product or any change in the speed of the product as it is conveyed past an adhesive applicator, the amount of adhesive dispensed onto the product per unit length of line of adhesive is constant. Curve L assumes that the timing controls of the system operate to maintain the correct length of line of adhesive applied to a product regardless of product or conveyor line speed or changes to the same.

Curve K is representative of a system using only the shaft speed encoder to control the amount of liquid dispensed per unit length of line dispensed. As the conveyor line speed increases, the amount of liquid dispensed also increases. There is only one speed where the actual amount of adhesive dispensed coincides with the ideal amount of adhesive which should be dispensed. Below such speed, too little adhesive is dispensed; above such speed, too much adhesive is dispensed.

Curve G is representative of the combined effects of the inventive apparatus and method as described herein when utilized to control the speed of an adhesive pump over the anticipated speed range of a product as it is conveyed past an adhesive applicator. The use of the inventive apparatus and method adjusts the amount of material dispensed from an adhesive applicator from that of curve K to that of curve G. As can be seen, except for low conveyor line speeds, the actual amount of material dispensed very closely coincides with the desired or ideal amount to be dispensed. The fact that curve G tracks back and forth or over and under curve L as product line speed increases is indicative of the continual adjustment to the pump 14 speed provided by the closed loop arrangement of FIG. 3. The initial portion of curve G where it deviates from curve L is inconsequential since it exists during the relatively few occasions and for the short time intervals when the product line or conveyor line speed is substantially at a standstill. Also, the amount dispensed is more rather than less and thereby does not affect product quality or reliability.

The control system, above-described, thus monitors, controls and adjusts the dispensing of adhesive by regulating the adhesive fluid pressure at the outlet of an adhesive pump in conjunction with signals eminating from the production line conveyor or shaft speed. Prototype testing has shown that this control system is repeatedly predictable in dispensing a predetermined length and quantity of adhesive at a predetermined location.

As previously noted, the inventive method and apparatus is not solely limited for use with adhesive dispensing systems. The invention may be utilized with, for example, eye liner shadow preparations which are dispensed as a liquid into a flat, elongated, open top container. The use of the invention herein with such applications negates the necessity to stop the conveyor line during filling or dispensing operations. The containers may be filled while constantly moving along the product conveyor line. The objectives in such eye liner or shadow preparation dispensing systems are virtually similar to that described above for the adhesive dispensing systems.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved especially as they fall within the breadth and scope of the claims here appended.

I claim:

1. A system for dispensing a liquid onto a product moving along a product conveyor line at a speed which may vary, comprising a supply of liquid pump means for pressurizing said liquid supply to a liquid operating pressure a liquid dispensing applicator conduit lines connecting said supply of liquid, said pump means and said applicator means for controlling the dispensing of the liquid at a predetermined location on the product and for controlling the dispensing time of the liquid in accordance with the speed of the conveyor line, and means for controlling the dispensing of the liquid to dispense a predetermined amount of liquid comprising a controller operable to receive at least two input signals and to send out at least one output signal, said input signals corresponding to the liquid operating pressure and a predetermined liquid operating pressure, said liquid operating pressure corresponding to the amount of liquid being dispensed, said controller being further operable to compare said input signals, determining the difference therebetween, and outputting said output signal in accordance with said difference, and wherein said control means for dispensing a predetermined amount of liquid further comprises means connected to said pump means for receiving said output signal and for adjusting said pump means to adjust said liquid operating pressure to substantially coincide with the predetermined liquid pressure.

2. The apparatus of claim 1 wherein said control means for comparing said input signals comprises a comparator-operational amplifier.

3. The apparatus of claim 1 wherein said predetermined liquid pressure input signal comprises a combined signal including a first portion multiplied by a second portion said first portion corresponding to the speed of said product conveyor line, said second portion being a predetermined multiplier signal and means for multiplying said first and second portions.

4. The apparatus of claim 3 wherein said first portion of the combined signal is output in volts from a shaft speed encoder operationally connected to said product conveyor line and said second portion of the combined signal is output in volts from electronic potentiometer means and input to an electronic multiplier, said first portion of the combined signal also being input to said multiplier, said multiplier outputting said combined signal in volts.

5. The apparatus of claim 1 wherein said predetermined liquid pressure input signal comprises a combined signal including a first portion added to a second portion, said first portion being the speed of said product conveyor line said second portion being a predetermined adder signal and means for adding said first and second portions.

6. The apparatus of claim 5 wherein said first portion of the combined signal is output in volts from a shaft speed encoder operationally connected to said product conveyor line and said second portion of the combined signal is output in volts from electronic potentiometer means and input to an electronic adder, said first portion of the combined signal also being input to said adder, said adder outputting said combined signal in volts.

7. The apparatus of claim 1 wherein said predetermined liquid pressure signal comprises a combined signal including a first portion multiplied by a second predetermined portion and a third predetermined portion added to said multiplied first and second portions, said first portion being the speed of said product conveyor line, including electronic means for multiplying said first and second portions and electronic means for adding said third portion to said multiplied first and second portions.

8. The apparatus of claim 7 wherein said first portion is output from a shaft speed encoder operationally connected to said product conveyor line, said second portion is output from electronic potentiometer means, said first and second portions being input to an electronic multiplier, the multiplied output from said multiplier being input to an electronic adder, said third portion being output from electronic potentiometer means and input to said electronic adder, said multiplied and added portions being input to said means for comparing said input signals.

9. The apparatus of claim 8 wherein said signal comprising the liquid operating pressure is output from a pressure transducer operationally connected to the output of said pump.

10. The apparatus of claim 9 wherein said control means for comparing said input signals comprises a comparator-operational amplifier, and said means for adjusting the pressure output from said pump comprises a motor and motor controller operationally connected to said pump with the output of said comparitor-operational amplifier being input to said motor controller.

11. The apparatus of claim 1 including means for providing flow of said liquid from said pump back to said liquid supply when said applicator is not activated.

12. The apparatus of claim 11 wherein said flow means comprises a flow bypass line connected at one end to the outlet of said pump and to said liquid supply at its other end with a flow restricting orifice interposed therebetween.

13. In a liquid dispensing system adapted to dispense by pressure, a liquid onto a product moving in accordance with a product conveyor line, said dispensing system including a supply of liquid pump means for pressurizing said liquid to a liquid operating pressure, a liquid dispensing applicator, conduit lines connecting said liquid supply, pump means and applicator, and control means for controlling the dispensing of the liquid in accordance with the speed of the conveyor line for a predetermined time and at a predetermined location on the product, a method for controlling the amount of liquid dispensed comprising the steps of comparing the liquid operating pressure with a predetermined liquid pressure and inputting the difference to a control device which adjusts the liquid operating pressure by adjusting said pump means to substantially coincide with the predetermined liquid pressure, said liquid operating pressure corresponding to the amount of liquid being dispensed.

* * * * *